US010987260B2

(12) United States Patent
Souke et al.

(10) Patent No.: US 10,987,260 B2
(45) Date of Patent: Apr. 27, 2021

(54) PATIENT HANDLING APPARATUS WITH HYDRAULIC CONTROL SYSTEM

(71) Applicant: Stryker Corporation, Kalamazoo, MI (US)

(72) Inventors: Chad Conway Souke, Portage, MI (US); Ross Timothy Lucas, Paw Paw, MI (US)

(73) Assignee: Stryker Corporation, Kalamazoo, MI (US)

( * ) Notice: Subject to any disclaimer, the term of this patent is extended or adjusted under 35 U.S.C. 154(b) by 209 days.

(21) Appl. No.: 15/949,648

(22) Filed: Apr. 10, 2018

(65) Prior Publication Data

US 2018/0303685 A1 Oct. 25, 2018

Related U.S. Application Data

(60) Provisional application No. 62/488,444, filed on Apr. 21, 2017.

(51) Int. Cl.
*A61G 1/056* (2006.01)
*A61G 1/02* (2006.01)

(52) U.S. Cl.
CPC ..... *A61G 1/0567* (2013.01); *A61G 1/0237* (2013.01); *A61G 2203/32* (2013.01)

(58) Field of Classification Search
CPC . A61G 1/0567; A61G 1/0237; A61G 2203/32
See application file for complete search history.

(56) References Cited

U.S. PATENT DOCUMENTS 3,530,514 A 9/1970 McCalley
3,627,377 A 12/1971 Pickles
(Continued)

FOREIGN PATENT DOCUMENTS

DE 3313843 A1 10/1984
EP 0364394 A2 4/1990
(Continued)

OTHER PUBLICATIONS

Stryker Bertec Medical Inc., "The Go Bed Electric Acute Care Bed Maintenance Manual", Dec. 2000, pp. 1-64.
(Continued)

*Primary Examiner* — David R Hare
*Assistant Examiner* — Adam C Ortiz
(74) *Attorney, Agent, or Firm* — Warner Norcross + Judd LLP

(57) ABSTRACT

A patient handling apparatus includes a frame, a base, and a lift assembly supporting the frame relative to the base, the lift assembly configured to extend or contract to raise or lower the base or the frame with respect to the other of the base and the frame. The patient handling apparatus further includes a control system, which comprises at least one hydraulic cylinder to extend or contract the lift assembly, a hydraulic circuit to direct the flow of hydraulic fluid to and from the hydraulic cylinder, and a controller operable to control the hydraulic circuit. Based on an input signal, for example, an input signal that is indicative of a status or condition of the patient handling apparatus, the controller is configured to open, optionally automatically, fluid communication between the rod end chamber and the cap end chamber to redirect a portion of the fluid output from the rod end chamber to the cap end chamber when the rod is extending to thereby increase the extension speed of the rod.

27 Claims, 9 Drawing Sheets

(56) References Cited

U.S. PATENT DOCUMENTS

| | | | | |
|---|---|---|---|---|
| 3,724,003 | A * | 4/1973 | Ellwanger | A61G 7/002 5/614 |
| 4,747,212 | A | 5/1988 | Cavdek | |
| 4,751,754 | A * | 6/1988 | Bailey | A61G 7/002 5/611 |
| 5,102,377 | A | 4/1992 | Spanski | |
| 5,161,274 | A | 11/1992 | Hayes et al. | |
| 5,355,743 | A | 10/1994 | Tesar | |
| 5,613,255 | A | 3/1997 | Bish et al. | |
| 6,071,228 | A | 6/2000 | Speraw et al. | |
| 6,289,534 | B1 | 9/2001 | Hakamiun et al. | |
| 6,352,240 | B1 * | 3/2002 | Eckstein | A61G 7/018 137/636.1 |
| 6,421,854 | B1 | 7/2002 | Heimbrock | |
| 6,611,979 | B2 | 9/2003 | Welling et al. | |
| 6,659,935 | B2 | 12/2003 | Costanzo | |
| 6,886,200 | B2 | 5/2005 | Blyshak et al. | |
| 7,140,055 | B2 | 11/2006 | Bishop et al. | |
| 7,150,056 | B2 | 12/2006 | Lemire | |
| 7,171,708 | B2 | 2/2007 | Osborne et al. | |
| 7,296,312 | B2 | 11/2007 | Menkedick et al. | |
| 7,441,291 | B2 | 10/2008 | Hayes et al. | |
| 7,454,805 | B2 | 11/2008 | Osborne et al. | |
| 7,533,429 | B2 | 5/2009 | Menkedick et al. | |
| 7,610,637 | B2 | 11/2009 | Menkedick et al. | |
| 7,653,954 | B2 | 2/2010 | Hornbach et al. | |
| 7,703,158 | B2 | 4/2010 | Wilker, Jr. et al. | |
| 7,886,380 | B2 | 2/2011 | Hornbach et al. | |
| 7,913,335 | B2 | 3/2011 | Carr | |
| 7,926,131 | B2 | 4/2011 | Menkedick et al. | |
| 8,074,309 | B2 | 12/2011 | Hutchison et al. | |
| 8,104,120 | B2 | 1/2012 | Hornbach et al. | |
| RE43,193 | E | 2/2012 | Osborne et al. | |
| 8,151,387 | B2 | 4/2012 | Osborne et al. | |
| 8,176,584 | B2 | 5/2012 | Hornbach et al. | |
| 8,256,048 | B2 | 9/2012 | Bly et al. | |
| 8,291,532 | B2 | 10/2012 | Hornbach et al. | |
| 8,321,976 | B1 | 12/2012 | Edgerton | |
| 8,458,833 | B2 | 6/2013 | Hornbach et al. | |
| 8,502,663 | B2 | 8/2013 | Riley et al. | |
| 8,607,384 | B2 | 12/2013 | Hornbach | |
| 8,621,690 | B2 | 1/2014 | Hornbach et al. | |
| 8,844,078 | B2 | 9/2014 | Hornbach et al. | |
| 9,227,822 | B2 | 1/2016 | Horne | |
| 2002/0178502 | A1 | 12/2002 | Beasley et al. | |
| 2004/0055087 | A1 | 3/2004 | Edgerton | |
| 2009/0165208 | A1 * | 7/2009 | Reed | A61G 1/0287 5/611 |
| 2010/0000017 | A1 | 1/2010 | Laloge et al. | |
| 2010/0199433 | A1 | 8/2010 | Clenet | |
| 2012/0124746 | A1 | 5/2012 | Andrienko et al. | |
| 2014/0033435 | A1 | 2/2014 | Jutras | |
| 2014/0041120 | A1 | 2/2014 | Li | |
| 2014/0189954 | A1 | 7/2014 | Lee | |
| 2014/0325759 | A1 | 11/2014 | Bly et al. | |
| 2016/0136021 | A1 | 5/2016 | Roussy et al. | |
| 2016/0302985 | A1 | 10/2016 | Tessmer et al. | |
| 2017/0172819 | A1 * | 6/2017 | Bourgraf | A61G 1/013 |
| 2018/0214326 | A1 | 8/2018 | Lacasse et al. | |

FOREIGN PATENT DOCUMENTS

| | | | |
|---|---|---|---|
| EP | 0736275 | B1 | 1/2000 |
| JP | H02156950 | A | 6/1990 |
| KR | 20140003301 | A | 1/2014 |
| WO | 9629970 | | 10/1996 |
| WO | 0117399 | A1 | 3/2001 |
| WO | 0117400 | A1 | 3/2001 |
| WO | 0123847 | A1 | 4/2001 |
| WO | 2007069912 | A1 | 6/2007 |
| WO | 2013066198 | A1 | 5/2013 |
| WO | 2014150652 | A1 | 9/2014 |
| WO | 2014191684 | A1 | 12/2014 |
| WO | 2015032003 | A1 | 3/2015 |

OTHER PUBLICATIONS

Stryker Bertec Medical Inc., "The Go Bed Electric Acute Care Bed Operations Manual", Dec. 2000, pp. 1-26.

* cited by examiner

PATIENT HANDLING APPARATUS WITH HYDRAULIC CONTROL SYSTEM

This application claims the benefit of U.S. Prov. Appl. Ser. No. 62/488,444, filed on Apr. 21, 2017, entitled PATIENT HANDLING APPARATUS WITH HYDRAULIC CONTROL SYSTEM, by Applicant Stryker Corporation, which is hereby incorporated by reference in its entirety.

TECHNICAL FIELD AND BACKGROUND OF THE INVENTION

The present invention relates to a patient handling apparatus, such as emergency cot, medical bed, stretcher, stair chair, or other apparatuses that support a patient and, more particularly, to a patient handling apparatus that provides a control system that can increase the deployment speed of a component of the patient handling apparatus.

For example, when a patient handling apparatus, such as an emergency cot, is unloaded from an emergency vehicle, such as an ambulance, the patient handling apparatus must typically be moved out of the vehicle sufficiently far where the base of the patient handling apparatus clears the ambulance deck and bumper so that the base can then be lowered. The faster the base can be lowered, the faster the patient handling apparatus can be unloaded, and the quicker the patient can be retrieved and delivered to the medical facility, typically an emergency room. Therefore, quick deployment of the base can be critical in some cases.

Accordingly, there is a need to provide a patient handling apparatus with a control system that can quickly move one component relative to another component, such as an emergency cot's base relative to the cot's frame.

SUMMARY OF THE INVENTION

Accordingly, the patient handling apparatus provides a lift assembly with a hydraulic system that can move one of the components relative to the other components more quickly when needed.

In one form, a patient handling apparatus includes a frame, a base, and a lift assembly supporting the frame relative to the base. The lift assembly is configured to extend or contract to raise or lower the base or the frame with respect to the other. The patient handling apparatus also includes at least one hydraulic cylinder to extend or contract the lift assembly, which has a rod, a cap end chamber, and a rod end chamber. The patient handling apparatus also includes a control system with a hydraulic circuit operable to direct the flow of hydraulic fluid to and from the hydraulic cylinder. The control system is configured to open fluid communication between the rod end chamber and the cap end chamber based on an input signal, for example an input signal that is indicative of a status or condition of the patient handling apparatus, to redirect a portion of the fluid output from the rod end chamber to the cap end chamber to thereby increase the extension speed of the rod.

In one aspect, the control system is configured to detect the presence or absence of an external force being applied to the base. The input signal is generated when the control system detects the absence of an external force being applied to the base.

In a further aspect, the control system is configured to no longer redirect the fluid output from the rod end chamber to the cap end chamber when the rod is retracting.

In another aspect, the control system is configured to (1) no longer redirect the fluid output from the rod end chamber to the cap end chamber and/or (2) stop the flow of fluid to the hydraulic cylinder when an external force is applied to the base.

In yet another aspect, the hydraulic circuit includes a valve to control the fluid communication between the rod end chamber and the cap end chamber, and the control system is configured to control the valve. For example, the valve may comprise a solenoid valve, with the control system in communication with the solenoid valve to control the opening or closing of the solenoid valve.

According to yet other aspects, the control system includes a sensor configured to detect the absence or presence of an external force applied to the base, and the control system is configured to open the valve in the absence of an external force applied to the base and when the rod is extending.

In addition, the control system may be configured to control the valve when the control system detects the presence of an external force applied to the base and/or slow or stop the flow of fluid to the hydraulic cylinder.

In other aspects, the control system further includes an apparatus-based communication system for communicating with a loading and unloading apparatus based communication system on a loading and unloading apparatus. For example, the apparatus-based communication systems may be wireless, such as RF communication systems.

In a further aspect, the control system is operable to open or close the solenoid valve based on a signal received from the loading and unloading based communication system.

According to other aspects, the patient handling apparatus further includes a motor to run the pump, wherein the control system is configured to detect a load on the motor (or the pump). For example, the input signal is a function of when the load on the motor. And, the control system may be configured to (1) no longer redirect fluid from the rod end chamber to the cap end chamber and/or (2) stop or slow the fluid flow to the hydraulic cylinder when the load on the motor is near, is at, or exceeds a prescribed value.

In yet other aspects, the control system is configured to detect the location of the frame relative to the base, and further is configured to close fluid communication between the rod end chamber and the cap end chamber when the base is at a prescribed location relative to the frame.

According to yet another aspect, the control system is configured to detect the location of the frame relative to the base or when the lift assembly is in a prescribed configuration and further is configured to (1) no longer redirect the fluid output from the rod end chamber to the cap end chamber and/or (2) slow or stop the flow of fluid to said hydraulic cylinder when said frame is near or at the prescribed location or the lift assembly is near or in the prescribed configuration.

In another embodiment, a patient handling apparatus includes a frame, a base, and a lift assembly supporting the frame relative to the base. The lift assembly is configured for extending or contracting to raise or lower the base or the frame with respect to the other of the base and the frame. The patient handling apparatus also includes a hydraulic cylinder and a hydraulic circuit controlling flow of hydraulic fluid to and from the hydraulic cylinder, and a control system (which includes a sensor) to control the hydraulic circuit. Based on an input signal from or status of the sensor, the control system is configured to redirect the fluid output from the rod end chamber to the cap end chamber when the rod is extending to thereby increase the extension speed of the rod.

In one aspect, the sensor detects the presence or absence of an external force being applied to the base.

In another aspect, the patient handling apparatus also includes a motor, and the hydraulic circuit includes a pump. The sensor detects the load on the motor or the pump.

In another aspect, the sensor detects the location of the base relative to the frame.

According to yet another aspect, the sensor detects the configuration of the lift assembly.

In another embodiment, a method of unloading a patient handling apparatus from a cargo area of an emergency vehicle includes moving the patient handling apparatus adjacent an opening to the cargo area of an ambulance and extending the base of the patient handling apparatus beyond the cargo area wherein the base is no longer supported by the emergency vehicle, and directing hydraulic fluid to the cap end of the hydraulic cylinder to extend the rod. The method further includes automatically redirecting a portion of the hydraulic fluid discharged from the rod end chamber of the hydraulic cylinder to the cap end chamber of the hydraulic cylinder to increase the speed of the rod when the rod is extending.

In one aspect, the method further includes stopping or slowing the flow of fluid to the hydraulic cylinder and/or terminating the redirecting when an external force is applied to the base.

In another aspect, the method further includes detecting when the base is supported by or contacts a ground surface, and stopping or slowing the flow of fluid to the hydraulic cylinder and/or terminating the redirecting when sensing that the base is supported by or contacts a ground surface.

In yet another aspect, the method further includes stopping or slowing the flow of fluid to the hydraulic cylinder and/or terminating the redirecting when the base is near or at a prescribed location relative to the frame. Additionally, the method includes sensing when the base is near or at the prescribed location relative to the frame.

According to yet another aspect, the method further includes stopping or slowing the flow of fluid to the hydraulic cylinder and/or terminating the redirecting based on the lift assembly being near or having a prescribed configuration. Additionally, the method includes sensing the configuration of the lift assembly, and comparing the configuration of the lift assembly to the prescribed configuration.

Accordingly, the present invention provides a patient handling apparatus with an improved control system that can quickly move one component relative to another, for example, in an emergency situation, in response to a variety of different conditions at the patient handling apparatus.

These and other objects, advantages, purposes and features of the invention will become more apparent from the study of the following description taken in conjunction with the drawings.

DETAILED DESCRIPTION OF THE INVENTION

Figure 1:
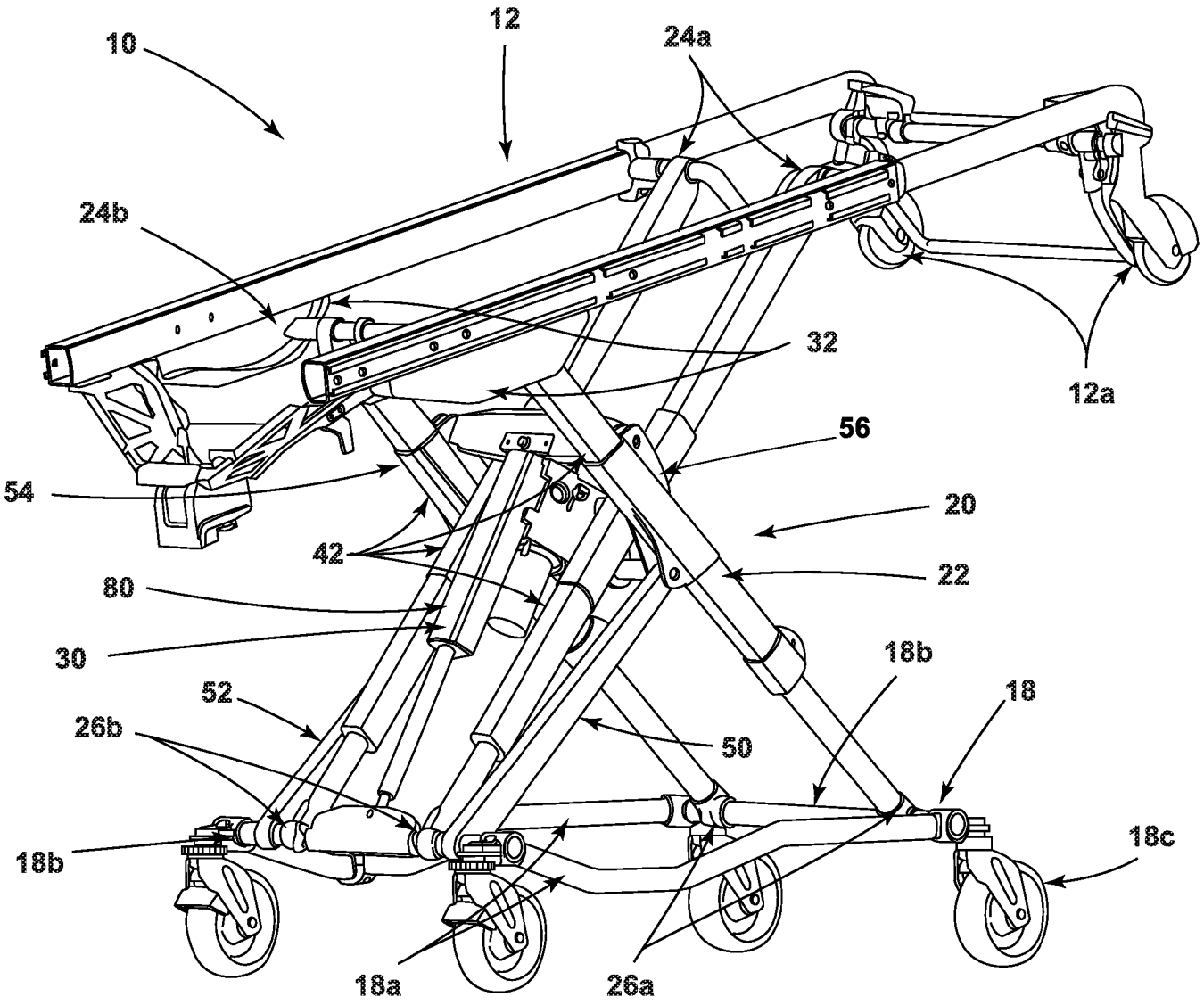
FIG. 1 is a perspective view of a patient handling apparatus (with the patient support surface removed) with the lift assembly in its fully raised configuration.

Referring to FIG. 1, the numeral 10 generally designates a patient handling apparatus. The term "patient handling apparatus" is used broadly to mean an apparatus that can support a patient, such as a medical bed, including an apparatus that can transport a patient, such as an emergency cot, a stretcher, a stair chair, or other apparatuses that support and/or transport a patient. Further, the term "patient" is used broadly to include persons that are under medical treatment or an invalid or persons who just need assistance. Although the patient handling apparatus 10 is illustrated as an emergency cot, the term "patient handling apparatus" should not be so limited.

Referring again to FIG. 1, patient handling apparatus 10 includes a frame 12, which in the illustrated embodiment comprises a litter frame that supports a litter deck (not shown), and a base 18. As will be more fully described below, patient handling apparatus 10 includes a lift assembly 20 that raises or lowers the base 18 or the frame 12 with respect to the other so that the patient handling apparatus 10 can be rearranged between a more compact configuration, for example, for loading into an emergency vehicle, such as an ambulance, and a configuration for use in transporting a patient across a ground surface. Further, as will be more fully described below, the mounting of lift assembly 20 to the frame 12 is optionally configured to allow the frame 12 to be tilted relative to the lift assembly 20 so that one end (e.g. head-end or foot-end) of the frame 12 can be raised beyond the fully raised height of the lift assembly to allow the patient handling apparatus to be inserted more easily into the compartment of an emergency vehicle.

Referring again to FIG. 1, frame 12 is mounted to base 18 by lift assembly 20, which includes load bearing members 22 pivotally coupled to the frame 12 and to the base 18. In the illustrated embodiment, load bearing members 22 are pivotally coupled to the frame 12 by head-end upper pivot connections 24*a* and foot-end upper pivot connections 24*b*. Further, as will be more fully described below, head-end upper pivot connections 24*a* are fixed to the frame 12 along the longitudinal axis 12*b* of frame 12 and foot-end upper pivot connections 24*b* are movable so that the head-end of frame 12 can be tilted upwardly, as more fully described below.

Figure 2:
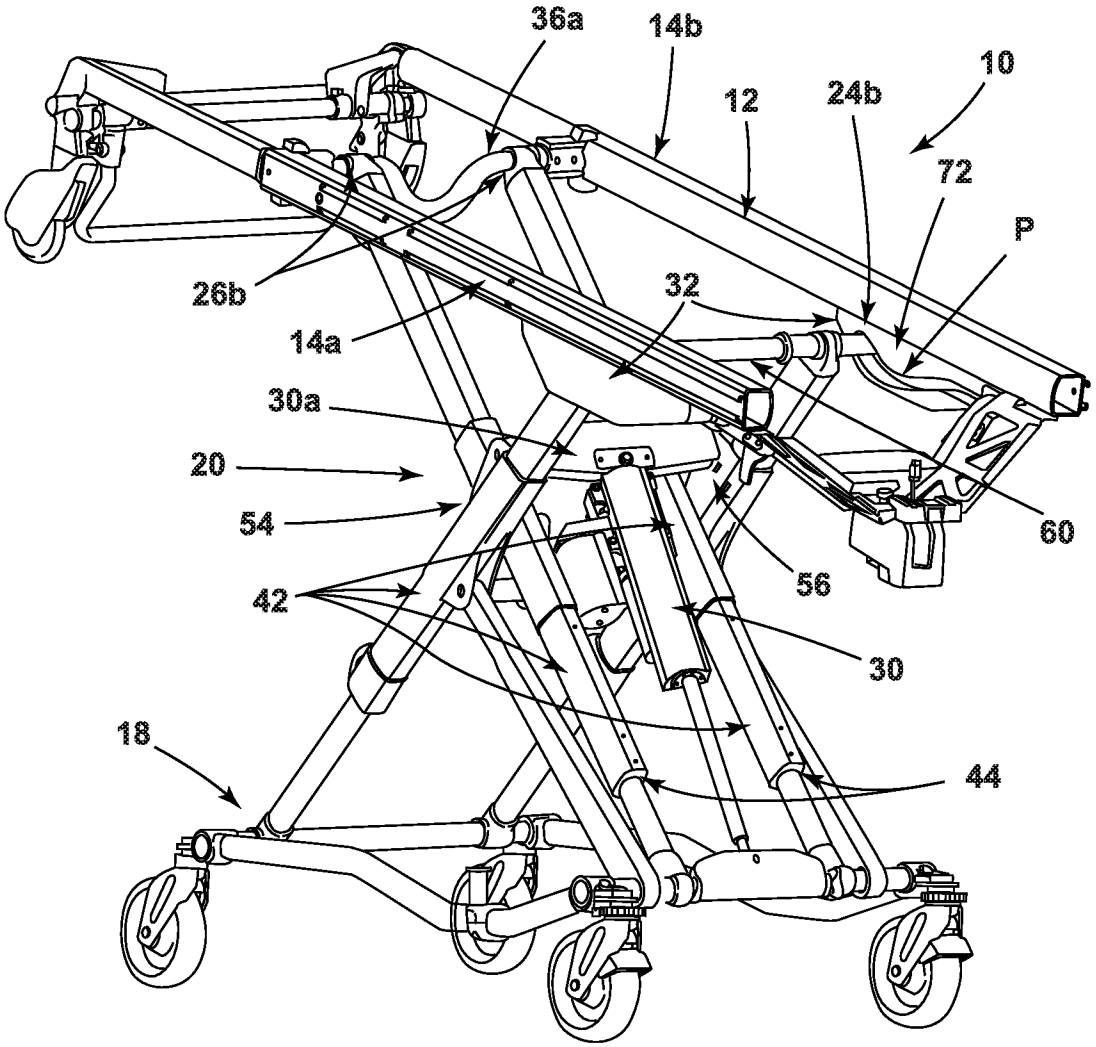
FIG. 2 is a second perspective view of the patient handling apparatus of FIG. 1.

In the illustrated embodiment, each load bearing member 22 comprises a telescoping compression/tension member 42. Compression/tension members 42 may be pivotally joined at their medial portions about a pivot axis to thereby form a pair of X-frames 44 (FIG. 2). The upper ends of each X-frame 44 are, therefore, pivotally mounted to the frame 12 by head-end upper pivot connections 24*a* and foot-end upper pivot connections 24*b*. The lower ends of each X-frame 44 are pivotally mounted to the base 18 by head-end lower pivot connections 26*a* and foot-end lower pivot connections 26*b*. However, it should be understood that load bearing members 22 may comprise fixed length members, for example such of the type shown in U.S. Pat. No. 6,701,545, which is commonly owned by Stryker Corp. of Kalamazoo, Mich. and incorporated herein by reference in its entirety.

In addition to load bearing members 22, patient handling apparatus 10 includes a pair of linkage members 50 and 52 (FIG. 1), which are pivotally mounted on one end to transverse frame members 18*b* of base 18 and on their other ends to brackets 54, 56 (FIG. 1), which mount to the X-frames and also provide a mount for a linear actuator 30 (FIG. 1), which extends or contracts the lift assembly to raise or lower frame 14 relative to the base 18 (or raise or lower base relative to the frame 12) described below. Brackets 54 and 56 therefore, pivotally mount linkage members 50 and 52, as well as actuator 30 (described below), to the X-frames 44 so that member 50, 52 provide a timing link function as well as a moment coupling function. It should be understood that multiple actuators may be used to raise or lower frame 12.

As best seen in FIG. 1, base 18 is formed by longitudinal frame members 18*a* and transverse frame members 18*b*, which are joined together to form a frame for base 18. Mounted to the longitudinal frame members 18*a* are bearings 18*c*, such as wheels or castors. Transverse frame members 18*b* provide a mount for the lower pivot connections 24*a*, 24*b* of load bearing members 22 and also for the rod end of the actuator 30. As described above, the upper end of actuator 30 is mounted between the X-frames (formed by load bearing members 22) by a transverse member 30*a* (FIG. 1A) that is mounted to brackets 54, 56.

As noted above, lift assembly 20 is extended or contracted by actuator 30. In the illustrated embodiment actuator 30 comprises a hydraulic cylinder 80, which is controlled by a control system 82. Although one actuator is illustrated, it should be understood that more than one actuator or cylinder may be used. As will be more fully described below, control system 82 includes a hydraulic circuit 90 and a controller 120, which is in communication with hydraulic circuit and a user interface 120*a* that allows an operator to select between the lifting, lowering, raising and retracting functions described herein. For example, user interface controls 120*a* may have a touch screen with touch screen areas or may comprise a key pad with push buttons, such as directional buttons, or switches, such as key switches, that correspond to the lifting, lowering, raising, and retracting functions described herein to allow the user to select the mode of operation and generate input signals to controller 120. As will be more fully described below, the controller 120 may also automatically control the mode of operation.

Referring again to FIGS. 6-8, cylinder 80 includes cylinder housing 84 with a reciprocal rod 86. Mounted at one end of rod 86 is a piston 88, which is located within the cylinder housing 84. The distal end of the reciprocal rod 86 is extended from housing 85 and connected in a conventional manner to transverse member 18*b* of base 18. And as described above, the other end or fixed end (or cap end) of cylinder 80 is mounted between brackets 54, 56.

Figure 6:
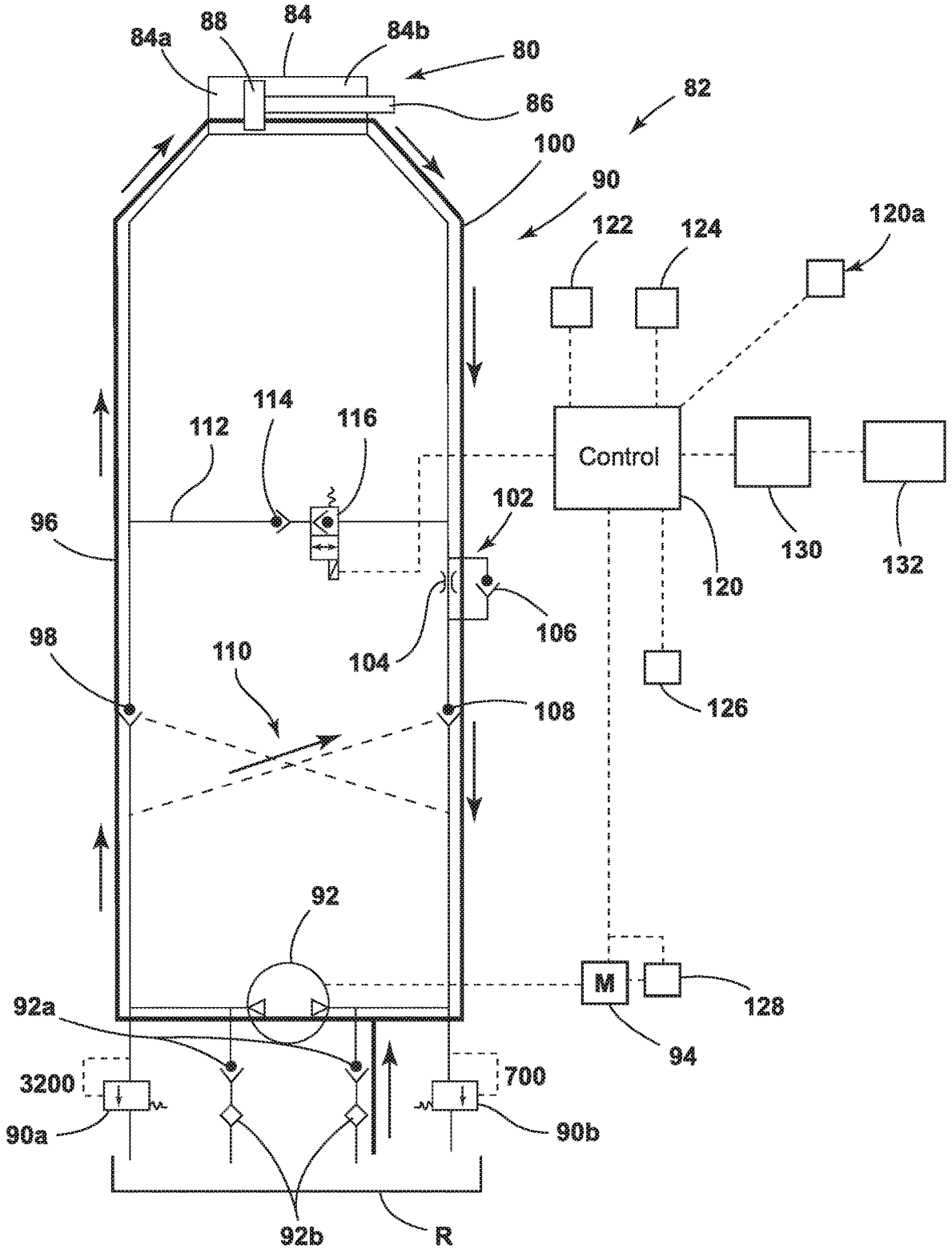
FIG. 6 is a hydraulic circuit diagram of the hydraulic system and control system in one embodiment of the ambulance patient handling apparatus illustrating the flow of hydraulic fluid in the lifting or raising mode of the frame relative to the base of the patient handling apparatus.
Figure 7:
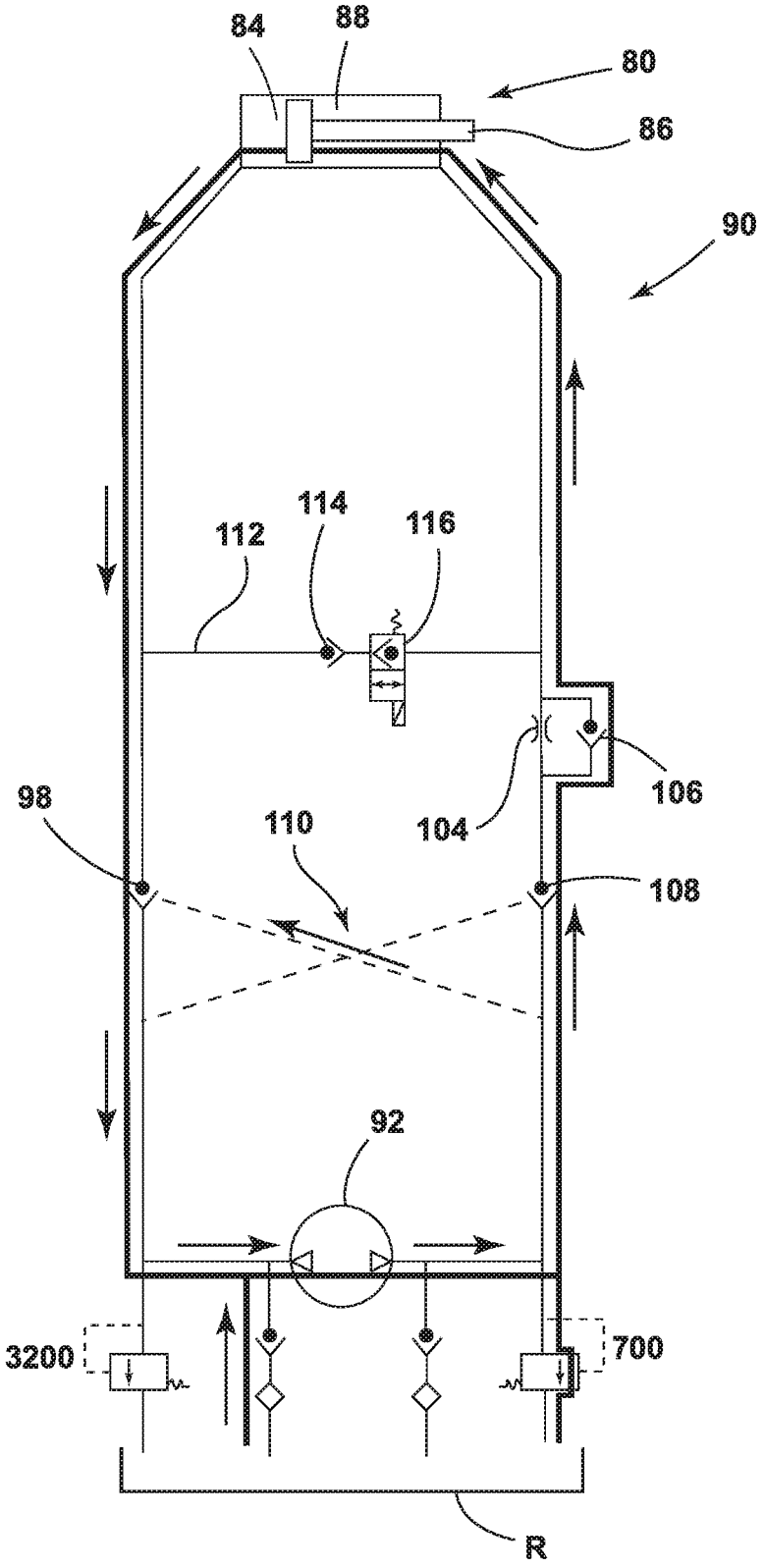
FIG. 7 is the hydraulic circuit diagram of FIG. 6 illustrating the flow of hydraulic fluid in the raising mode of the base of the patient handling apparatus.

Cylinder 80 is extended or retracted by control system 82 to extend or contract lift assembly 20 and generally operates in four modes, namely (mode 1) to raise the frame 12 when base 18 is supported on, for example, a ground surface (FIG. 6), (mode 2) to lower the frame 12 when base 18 is supported on, for example, a ground surface (FIG. 7), (mode 3) to lower or extend base 18 when apparatus 10 is its compact configuration and when the frame 12 is supported, for example, by an attendant or a loading and unloading apparatus (FIG. 8), or (mode 4) to raise base 18 when apparatus 10 is its extended configuration and when the frame 12 is supported, for example, by an attendant or a loading and unloading apparatus (FIG. 7). As will be more fully described below, when lowering or extending base 18 relative to frame 12 (when frame 12 is supported) control system 82 is configured to automatically lower or extend base 18 at a faster speed unless certain conditions exist.

Figure 8:
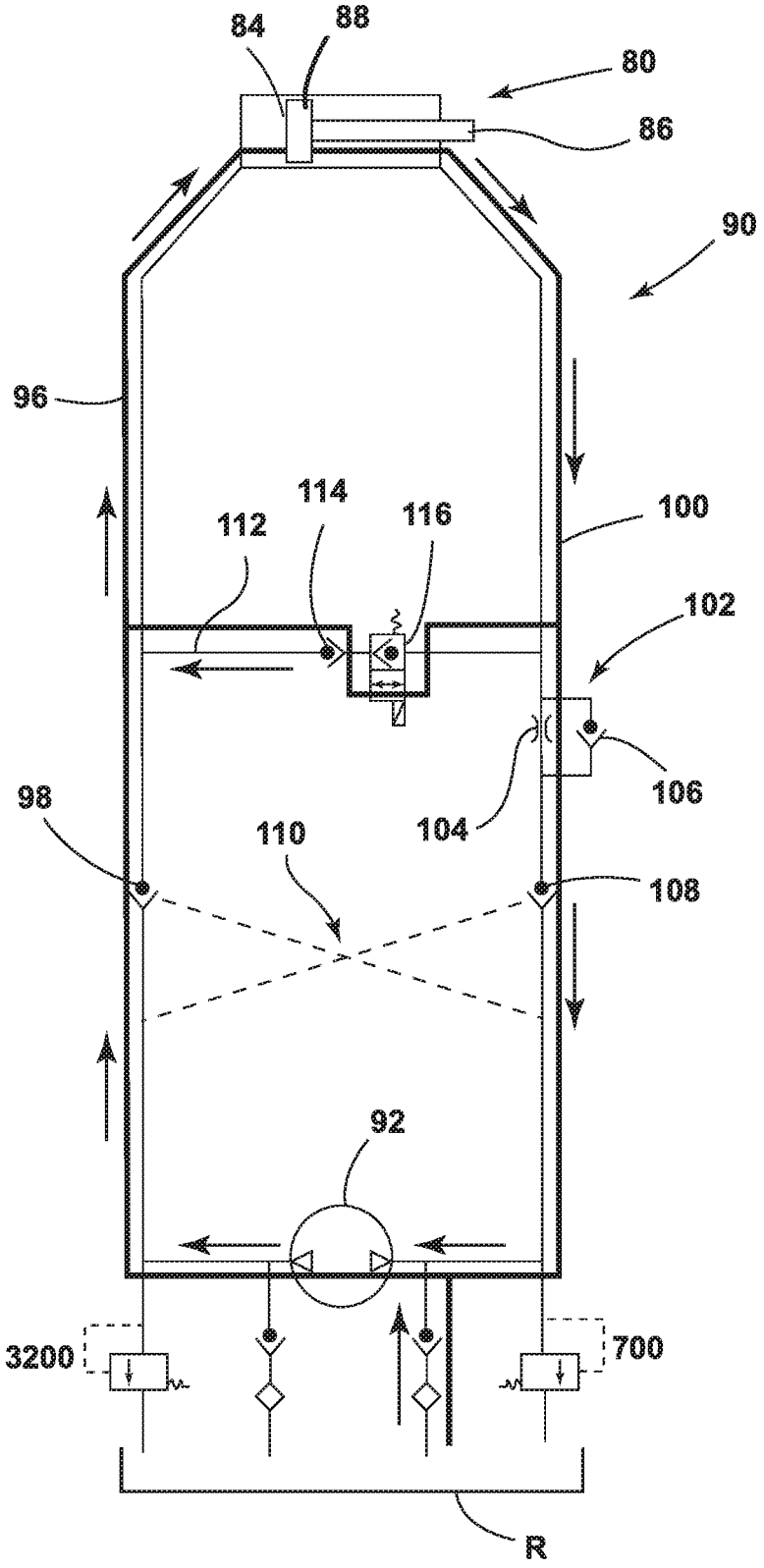
FIG. 8 is the hydraulic circuit diagram of FIG. 6 illustrating the flow of hydraulic fluid in the lowering mode of the base of the patient handling apparatus.

Referring to FIGS. 6-8, hydraulic circuit 90 includes a pump 92, which is in fluid communication with a fluid reservoir R, to pump fluid from the reservoir R to the cylinder 80. As best seen in FIG. 6, when a user selects the first mode of operation (via the user interface) to raise or lift the frame 12, controller 120 powers motor 94, which operates pump 92 to pump fluid from the reservoir R, through filters 92*b* and check valves 92*a*, into the hydraulic circuit 90 to direct the flow of fluid to cylinder 80. To avoid over pressurization, for example, when a heavy patient is supported on frame 12, fluid may be discharged from the hydraulic circuit 90, for example, when the pressure in the hydraulic circuit 90 exceeds a designated pressure (e.g. 3200 psi on the cap side of the hydraulic circuit, and 700 psi on the rod side of the hydraulic circuit) through pressure relief valves 90*a* and 90*b*. It is to be understood that the pump 92, cylinder 80, and the various conduits carrying hydraulic fluid to the cylinder are preferably always filled with hydraulic fluid. Pump 92 is driven by an electric motor 94 (both of which are optionally reversible), which motor is controlled by controller 120 to thereby control pump 92.

Referring again to FIG. 6, when an operator wishes to raise frame 12 relative to base 18 (mode 1), and base 18 is supported on a support surface, the operator, using interface controls 120*a* (FIG. 6), generates input signals that are communicated to controller 120. When operating in the first mode (mode 1), the output of the pump 92 (in the direction indicated by the arrows in FIG. 6), will supply hydraulic fluid through a hydraulic conduit 96, which includes a pilot operated check valve 98, to the cap end chamber 84*a* of the cylinder housing 84, which is on the piston side of rod 86. When fluid is directed to cap end chamber 84*a*, the rod 86 will extend to raise the frame 12 relative to base 18 at a first speed. This mode of operation is used when base 18 is supported on a support surface, such as the ground, which can be detected by a controller 120 in various ways described below. It should be understood, that mode 1 may also be used to lower or extend base 18 when the faster speed of mode 3 described below is not appropriate or desired.

Referring to FIG. 7, when an operator user wishes to select mode 2 or 4—that is lower the frame 12 relative to base 18 (when base 18 is supported on a support surface) or raise base 18 relative to frame 12 (when frame 12 is supported), using interface controls 120*a*, the operator will generate an input signal to controller 120 that will cause controller 120 to operate in mode 2 or 4. In mode 2 or 4, the direction of pump 92 is reversed, so that fluid will flow in an opposite direction (see arrows in FIG. 7) to cylinder 80 through a second hydraulic conduit 100, which is in fluid communication and connected to the rod end chamber 84*b* of the cylinder housing 84. Conduit 100 includes a check valve assembly 102, with an orifice or fluid throttle 104 and a poppet or check valve 106 in parallel, to control the flow of fluid through conduit 100. Fluid flow in this direction will cause the rod 86 to retract and raise the base 12 when the frame 12 is supported or lower the frame 12 relative to base 18 when the base 18 is supported. Also provided is a pilot operated check valve 108 connected between the valve assembly 102 and pump 92. Optionally, valves 98 and 108 are provided by a dual pilot operated check valve assembly 110, which includes both valves (98 and 108) and allows fluid flow through each respect conduit in either direction. The valves 98 and 100 of the dual pilot check valve are operated by the fluid pressure of the respective branch of fluid conduit (96 or 100) as well as the fluid pressure of the opposing branch of fluid conduit (96 or 100), as schematically shown by the dotted line in FIGS. 6-8.

Referring to FIG. 8, when an operator selects the base 18 lowering function and the litter is supported (and the base is unsupported), controller 120 will automatically increase the speed of the cylinder 80 over the first speed (mode 3) (as would be understood by those skilled in the art, the speed of the cylinder or cylinders may be increased by increasing the flow of hydraulic fluid and/or pressure of the hydraulic fluid flowing to the cylinder (s)) unless certain conditions exist. Optionally, user interface 120*a* may allow an operator to generate an input signal to select mode 3 and/or to disable mode 3.

In order to speed up the extension of rod 86 when operating in mode 3, hydraulic circuit 90 includes a third hydraulic conduit 112, which is in fluid communication with conduits 96 and 100 via a check valve 114, to thereby allow fluid communication between the cap end chamber 84*a* and the rod end chamber 84*b* and to allow at least a portion of the fluid output from the rod end chamber 84*b* to be redirected to the cap end chamber 84*a*, which increases the speed of the rod 86 (i.e. by increasing the pressure and/or fluid flow of the fluid delivered to the end cap chamber 84*a*).

To control (e.g. open and close) fluid communication between the cap end chamber 84*a* and rod end chamber 84*b* via conduit 112, conduit 112 includes a valve 116, such as a solenoid valve or a proportional control valve, which is normally closed but selectively controlled (e.g. opened) to open fluid communication between the rod end chamber 84*b* and the cap end chamber 84*a* as described below. As noted, this will allow at least a portion of the fluid output from the rod end chamber 84*b* to be redirected to the end cap chamber 84*a* to thereby increase the speed of rod 86. Optionally, an additional valve, such as a solenoid valve, may be included in conduit 100, for example, between conduit 112 and pump 92, which is normally open but can be selectively controlled (e.g. closed), so that the amount of fluid (and hence fluid pressure and/or fluid flow) that is redirected from the rod end chamber 84*b* may be varied. For example, all the fluid output from may be redirected to the cap end chamber 84*a*. In another embodiment, an additional electrically operated proportional control valve may be used in any of the branches of the conduit (e.g. 96, 100, or 112) to control the rate of fluid flow through the respective conduits and thereby control and vary the speed of the extension of rod 86.

As noted above, control system 82 includes controller 120, which is also schematically represented in FIG. 6. Controller 120 may be powered by the battery (not shown) on board the patient handling apparatus 10. A hydraulic fluid pressure monitoring device (not shown) may be connected to the hydraulic circuit 90 to provide a signal to controller 120 indicative of the magnitude of the fluid pressure, which may be used as input when controlling the hydraulic cylinder 80.

Referring again to FIG. 6, controller 120 may be in communication with one or more sensors, which generate input signals to controller 120 (or controller 120 may detect the state of the sensor) to allow controller 120 to adjust the hydraulic circuit based on an input signal or signals from or the status of the sensors, described more fully below. Suitable sensors may include Hall Effect sensors, proximity sensors, reed switches, optical sensors, ultrasonic sensors, liquid level sensors (such as available from MTS under the brand name TEMPOSONIC), linear variable displacement transformer (LVDT) sensors, or other transducers or the like.

For example, controller 120 may control (e.g. open or close) the valve 116 to increase or stop the increased speed of cylinder 80 and/or slow or stop the pump to slow or stop the cylinder, or any combination thereof based on an input signal or signals from or the status of the sensor(s). Further, controller 120 may control (e.g. close) the valve 116 before, after, or at the same time as slowing or stopping the pump based on an input signal or signals from or the status of the sensor(s). Alternately, controller 120 may slow or stop the pump P in lieu of control (e.g. close) the valve 116 based on an input signal or signals from or the status of the sensor(s).

In one embodiment, control system 82 may include one or more position sensors provided on the patient handling apparatus 10. More specifically, control system 82 may include one or more sensors 122 (FIG. 6) that are used to detect when the base 18 of the patient handling apparatus 10 is contacting the ground or other surface, such as a bumper or another obstruction, which, as noted, may be used as an input signal or signals to the controller 120 to control the hydraulic circuit 90. A suitable sensor may include a transducer, such as a pressure sensor, including a load cell, for example, mounted to one or more of the wheels or casters, which detect when an upward force is applied to the wheels or casters. Alternately, as described below, control system 82 may include one or more sensors to detect the increase in the load on the motor, for example, by detecting an increase in the motor's current, to detect when the base 18 is supported. Other suitable sensors (as noted above) may be used.

For example, when control system 82 detects that the base 18 is contacting or nearly contacting a ground surface or an obstruction, controller 120 may be configured to close valve 116 to no longer allow fluid communication between the rod end chamber 84*b* and the cap end chamber 84*a* via conduit 112 and, further, to stop the pump. In this manner, cylinder 80 will not be driven at the increased speed and, further, optionally stopped when base 18 is supported, for example on the deck of the emergency vehicle or when it is supported on a ground surface, or if it encounters an obstruction. Additionally, controller 120 may slow or stop the pump, either before, after or at the same time as closing valve 116, or instead of closing valve 116. Optionally, before, after or at the same time as closing valve 116, controller may reverse the motor to avoid excess pressure build up in the hydraulic circuit 90.

So for example, if an attendant is removing patient handling apparatus from an emergency vehicle, and the operator has selected a lowering base function, and controller 120 detects that the base 18 is no longer supported, controller 120 will automatically open valve 116 so that cylinder 80 will be driven at the increased speed. On the other hand, once base 18 contacts or nearly contacts the ground surface and/or the base 18 is fully or nearly fully lowered, as will be more fully described below, controller 120 may close valve 116 so that cylinder 80 can no longer be driven at the increased speed and, further, may stop pump 92 so that cylinder 80 will no longer extend. As noted above, controller 120 may reverse the motor to avoid excess pressure in hydraulic circuit 90. Further, as noted, controller 120 may optionally stop pump 92 in lieu of closing valve 116.

In addition, or alternately, control system 82 may include one or more sensors 124 (FIG. 6) that detect the height of the patient handling apparatus 10. As noted above, suitable sensors may include Hall Effect sensors, proximity sensors, reed switches, optical sensors, ultrasonic sensors, liquid level sensors (such as available from MTS under the brand name TEMPOSONIC), linear variable displacement transformer (LVDT) sensors, or the like.

Figure 1A:
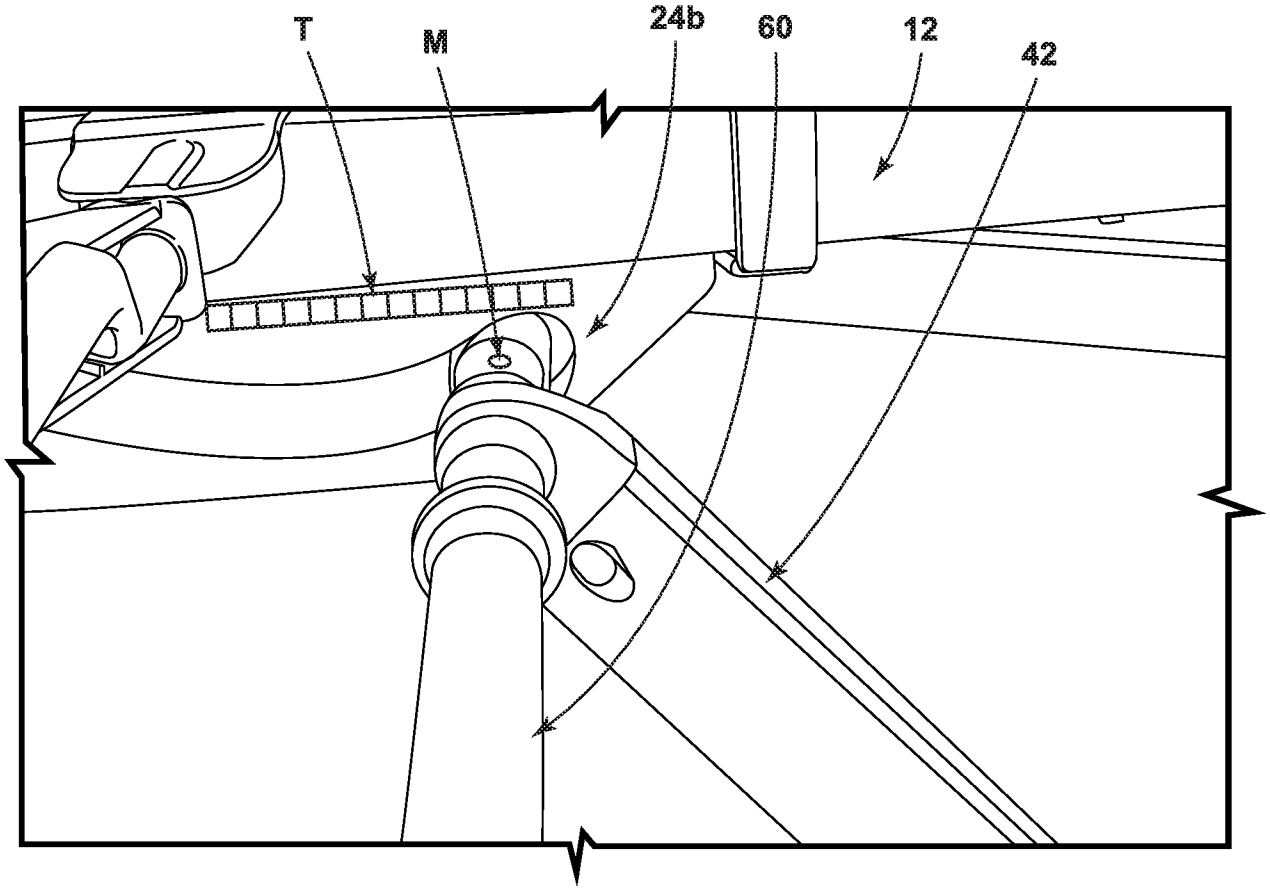
FIG. 1A is an enlarged view of a foot-end upper pivot connection between the lift assembly and the frame.
Figure 4:
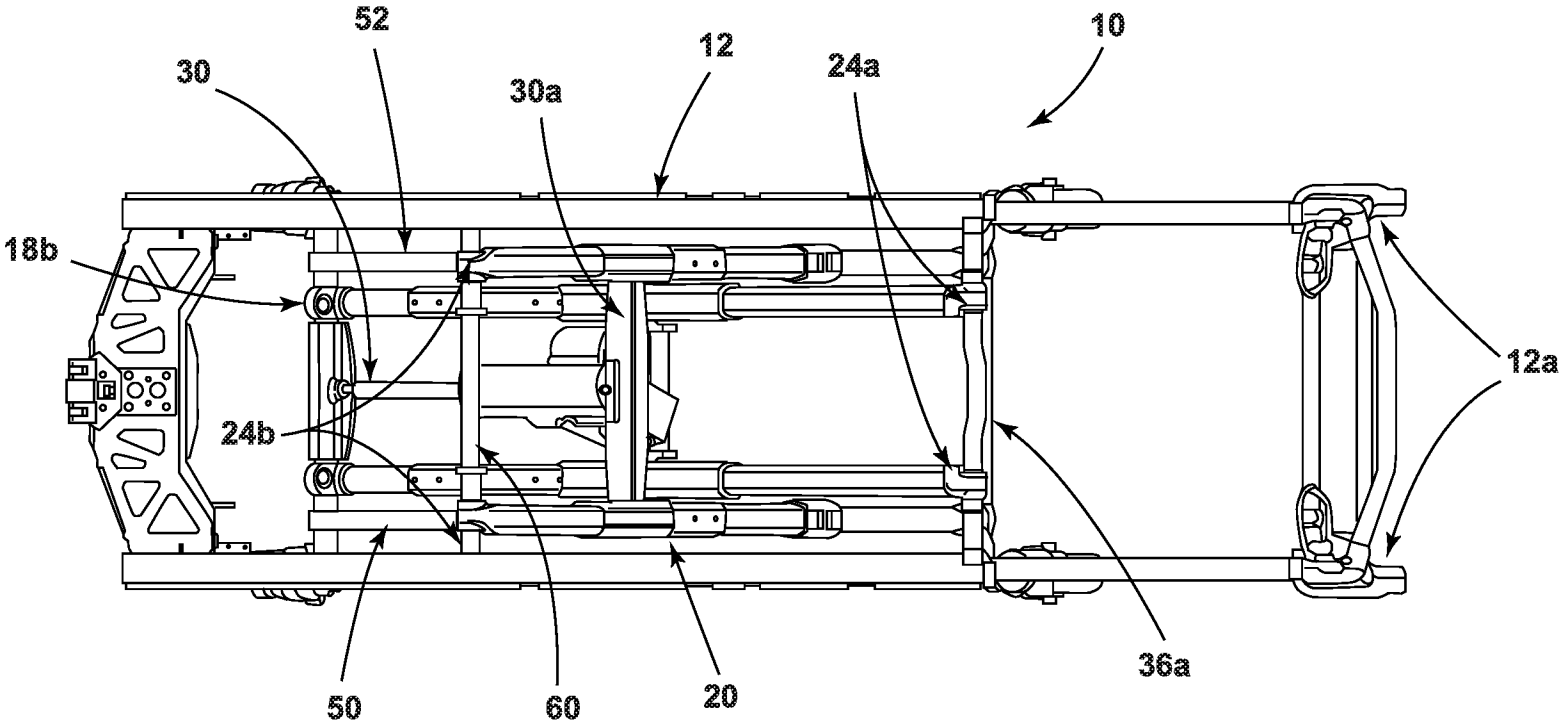
FIG. 4 is a top plan view of the patient handling apparatus of FIG. 3.
Figure 5:
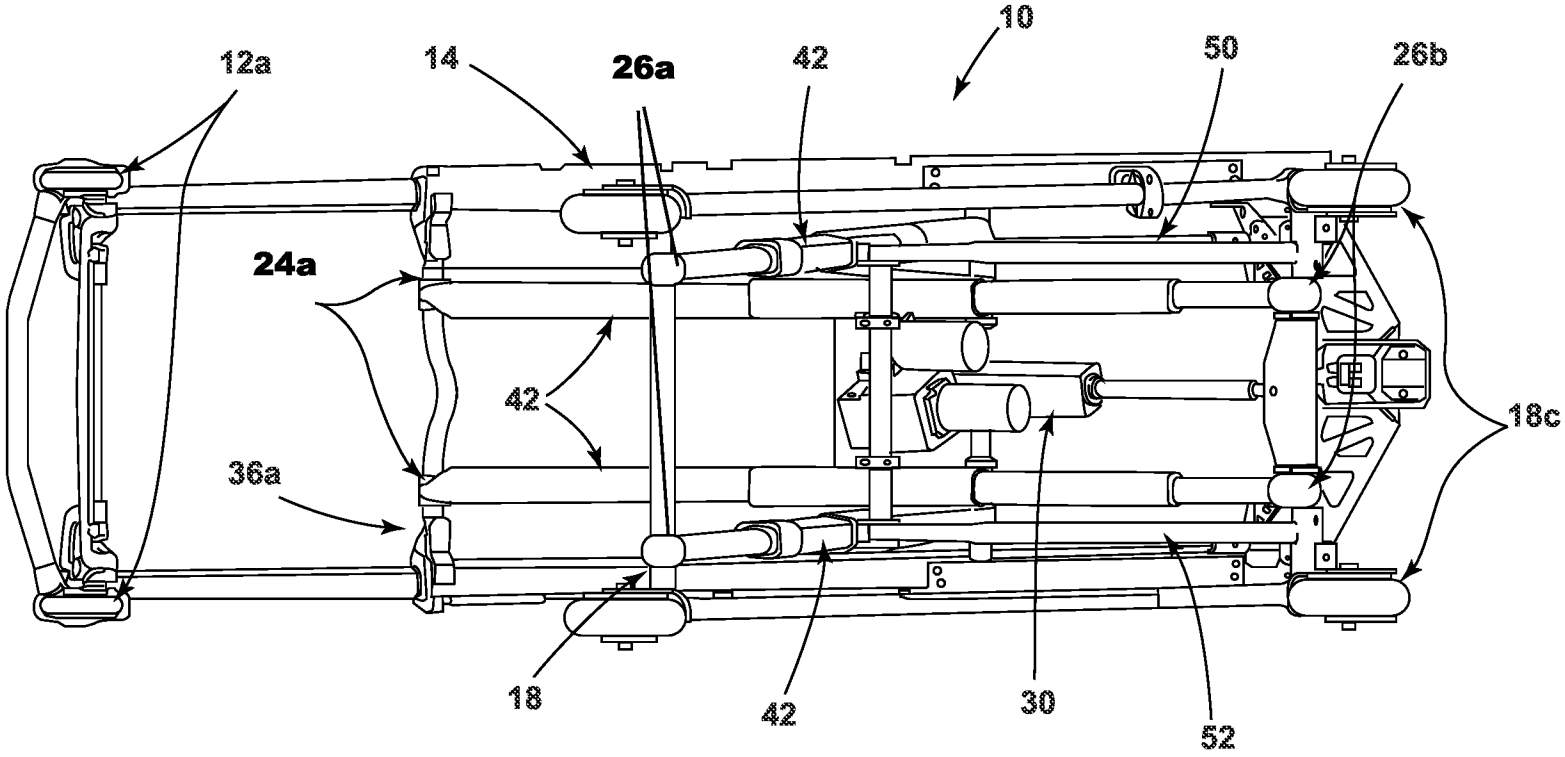
FIG. 5 is a bottom plan view of the patient handling apparatus of FIG. 3.

For example, in one embodiment, referring to FIG. 1A, an array of transducers T may be attached to the frame 12, and a magnet M mounted, for example, to the foot-end upper pivot connections 24*b*, including for example, to transverse member 60 forming or supporting the foot-end upper pivot connections 24*b* (e.g. FIGS. 2 and 4). The array of transducers T may be mounted to frame 12 adjacent to or incorporated in guide 32 along path P, as partially shown in FIG. 1A. In this manner, as the foot-end upper pivot connections 24*b* move along path P magnet M will also move along the array of transducers, and the magnetic field of the magnet will be detected by one or more of transducers T to create an input signal or signals to the controller 120 that is indicative of the height position of the patient handling apparatus 10.

Controller 120, based on this signal or these signals, may control the hydraulic circuit 90. For example, controller 120 may have a height value stored therein (in the controller's memory or a separate memory in communication with controller 120) against which controller 120 compares the signal or signals. Based on whether the detected height (detected by the transducer or transducers) exceeds or is equal to or is less than the stored height value, controller 120 may be configured to control (e.g. open or close) valve 116. For example, when operating in mode (3), where valve 116 is open to increase the speed of rod 86, if controller 120 detects that the height of frame 12 is near or at (or exceeds) the stored height value, then controller may be configured to close valve 116 to no longer drive cylinder 80 at the increased speed, and either before, after, or while closing valve 116 may optionally slow or stop the pump. Further, as noted above, controller 120 may reverse the motor to avoid excess pressure in hydraulic circuit 90. Alternately, controller 120 may optionally stop pump 92 in lieu of closing valve 116.

In one embodiment, the stored height value may be less than the maximum height, and, therefore, controller 120 may be configured to close valve 116 before lift assembly reaches its maximum height. Additionally, as generally described above, controller 120 may be configured to slow or stop the pump to prevent overshoot. Further, on the other hand if the stored height value is the maximum height of lift assembly (e.g. the height at which pivot connections 24*b* reaches the position along the guide path as viewed in FIG. 1A)), then controller 120 may configured to also to stop pump 92 either before, after or at the same time controller closes valve 116.

In this manner, when control system 82 does not detect that the base 18 is at a specified height, e.g. when the transducers do not yet detect the magnets that correspond to a specified height of the base 18, control system 82 can operate cylinder at an increased speed but when it detects that the base 18 is near, at or exceeds the specified height, controller 120 may be configured to control hydraulic circuit 90 to slow or stop the extension of rod 86 of cylinder.

In another embodiment, control system 82 can operate cylinder 80 at an increased speed but when it detects that the base 18 is at a height approaching or near the specified height (e.g. before the base 18 reaches the ground or before lift assembly 20 reaches its maximum height or before reaching a prescribed configuration), controller 120 may be configured to control hydraulic circuit 90 to slow or stop the extension of rod 86 of cylinder, using any of the methods described above. That is either by controlling (e.g. closing) valve 116, slowing or stopping the pump, or reversing the motor.

In yet another embodiment, control system 82 may include one or more sensors 126 (FIG. 6) that detect the configuration of the ambulance patient handling apparatus 10. For example, similar to sensor 124 noted above, transducers (see above for list of suitable transducers or sensors) may be placed at different locations about the patient handling apparatus 10 that detect magnets also placed at different locations about the patient handling apparatus 10. In this manner, when a magnet is aligned with the transducer (or one of the transducers), the magnet field will be detected by that transducer, which then generates a signal or signals that indicate that the patient handling apparatus 10 is in a defined configuration (associated with that transducer) of the patient handling apparatus 10. The number of configurations may be varied—for example, a single sensor may be provided to detect a single configuration (e.g. fully raised configuration or a fully lowered configuration) or multiple sensors may be used to detect multiple configurations, with each transducer detecting a specific configuration. Again, the sensors create an appropriate input signal to the controller 120 that is indicative of the configuration of the patient handling apparatus 10.

Further, when multiple configurations are detected, controller 120 may compare the detected configuration of patient handling apparatus 10 to a prescribed configuration and, in response, control the hydraulic circuit 90 based on whether the patient handling apparatus 10 is in or near a prescribed configuration or not. Or when only a single configuration is detected, controller 120 may simple use the signal from the sensor as an input signal and control hydraulic circuit 90 based on the input signal.

When the patient handling apparatus 10 is no longer in the prescribed configuration (e.g. by comparing the detected configuration to a prescribed configuration stored in memory or detecting that it is not in a prescribed configuration), controller 120 may be configured to open or reopen the valve 116 to allow cylinder 80 to operate at its increased speed but then close valve 116 when controller 120 detects that patient handling apparatus 10 is in a prescribed configuration and/or, further, may slow or stop the motor to stop the pump or reverse the motor.

For example, one of the prescribed configurations may be when the lift assembly is in its fully raised configuration. In this manner, similar to the previous embodiment, when controller 120 detects that patient handling apparatus 10 is near or in its fully raised configuration, controller 120 may be configured to close valve 116 so that cylinder 80 can no longer be driven at the increased speed, and further may also stop motor 94 to stop pump 92. As noted above, controller 120 may open or close the valve 116 before, after, or at the same time as stopping the pump (or reversing the motor) based on the input signal or signals from or the status of the sensor(s). Alternately, controller 120 may stop the pump 92 in lieu of closing the valve 116 based on an input signal or signals from or the status of the sensor(s).

In yet another embodiment, the control system 82 may include a sensor 128 (FIG. 6), which is in communication with controller 120, to detect when a load on the motor (or on the pump) occurs. For example, sensor 128 may detect current. In this manner, using sensor 128, controller 12 can detect when the base is supported on a surface, such as the ground or the deck of the emergency vehicle, by detecting when the motor or pump encounter increased resistance, for example, by detecting the current in the motor. As would be understood, this increase resistance would occur when the base 18 is either supported or encounters an obstruction. Further, controller 120 may be configured to detect when the load has exceeded a prescribed value (e.g. by comparing the detected load to a store load value in memory), and optionally close valve 116 to no longer allow fluid communication between the rod end chamber 84*b* and the cap end chamber 84*a* via conduit 112 when the load has exceeded the prescribed value. As noted above, controller 120 may open or close the valve 116 before the load reaches the prescribed value and further before, after, or at the same time as slowing or stopping the pump based on an input signal or signals from or the status of the sensor(s). As noted above, controller may also reverse the motor before, after or at the same time it closes valve 116. Alternately, controller 120 may slow or stop the pump 92 in lieu of closing the valve 116 based on an input signal or signals from or the status of the sensor(s).

So for example, if an attendant is removing patient handling apparatus from an emergency vehicle and has selected the base lowering (or extending) function, and while the base is being lowered at the increased speed, controller 120 detects that the motor or pump is under an increase in load (e.g. detects an increase in current) (which, as noted, would occur when the base 18 is supported, either by a support surface or an obstruction) controller 120 may close valve 116 so that cylinder 80 will no longer be driven at the increased speed. Optionally, controller 120 may also or instead slow or stop the pump and/or stop the pump before closing the valve. Alternately, controller 120 may simultaneously close the valve 116 and slow or stop the pump. As described above, in yet another embodiment, controller 120 may close the valve 116 prior to base 18 being supported (for example, when the frame 12 or base 18 reaches a prescribed height or when apparatus 10 has a prescribed configuration) and only after controller 120 detects that base 18 has contacted the ground surface and/or the base 18 is fully lowered, controller 120 will stop pump 92 so that cylinder 80 will no longer extend. Or the controller 120 may be configured to stop the pump 92 before the base reaches the ground to avoid overshoot.

The controller 120 may also receive signals indicative of the presence of the patient handling apparatus 10 near an emergency vehicle. For example, a transducer may be mounted to the patient handling apparatus 10, and a magnet may be mounted to the emergency vehicle and located so that when the patient handling apparatus is near the emergency vehicle, the transducer will detect the magnet and generate a signal based on its detection. In this manner, when an operator has selected the base extending (e.g. lowering) function and controller 120 detects that patient handling apparatus 10 is near an emergency vehicle and, further, detects one or more of the other conditions above (e.g. that the base is not contacting a support surface or there is no load on the motor or pump or the patient handling apparatus 10 is not in a prescribed configuration), controller 120 may open valve 116 to allow the cylinder to be driven at the increased speed. In this manner, these additional input signals may confirm that the situation is consistent with a mode 3 operation.

Alternately, controller 120 may also receive signals indicative of the presence of the patient handling apparatus 10 in an emergency vehicle. For example, a transducer may be mounted to the patient handling apparatus 10, and a magnet may be mounted to the emergency vehicle and located so that when the patient handling apparatus is in the emergency vehicle, the transducer will detect the magnet and generate a signal based on its detection. In this manner, when an operator has selected the base lowering function and controller 12 detects that patient handling apparatus 10 is in the emergency vehicle and detects one or more of the other conditions above (e.g. that the base is not contacting a support surface or there is no load on the motor or pump or the patient handling apparatus 10 is not in a prescribed configuration), the signal indicating that patient handling apparatus 10 is in the emergency vehicle will override the detection of the other conditions and the controller 120 may maintain valve 116 closed to prevent the cylinder from being driven at the increased speed and, further, override the input signal generated by the operator.

In yet another embodiment, the patient handling apparatus 10 may include a patient handling apparatus-based communication system 130 (FIG. 6) for communicating with a loading and unloading based communication system 132 (FIG. 6) on a loading and unloading apparatus. For example, the communication systems 130, 132 may be wireless, such as RF communication systems (including near-field communication systems). For example, the control system 82 may be operable to open or close the valve 116 based on a signal received from the loading and unloading based communication system 132. In this manner, the deployment of the base of the patient handling apparatus 10 may be controlled by someone at the loading and unloading apparatus or someone controlling the loading and unloading apparatus.

In one embodiment, rather than allowing controller 120 to start in mode 3 (when all the conditions are satisfied), controller 120 may be configured initially start the base lowering function in mode 1, where the base is lowered at the slower, first speed. Only after controller 120 has checked that there is a change in the load (e.g. by checking a sensor, for example a load cell or current sensing sensor) on the motor or cot to confirm that the motor or pump are now under a load (which would occur once the apparatus is pulled from the emergency vehicle and the base is being lowered), does controller 120 then switch to mode 3 to operate the cylinder at the faster, second speed. Again, once operating in mode 3, should controller 120 detect one or more of the conditions noted above (base 18 is supported or encounters an obstruction, the height exceeds a prescribed height, the configuration is in a prescribed configuration, the load on the motor or pump exceeds a prescribed value) controller 120 will close valve 116 and optionally further slow or stop pump. As noted above, the valve 116 may be closed by controller 120 after the pump 92 is slowed or stopped or simultaneously.

In any of the above embodiments, it should be understood that control system 82 can control hydraulic circuit 90 to slow or stop the extension of rod 86 of cylinder, using any of the methods described above, before the conditions noted above, such as before reaching a predetermined height, before reaching a predetermined configuration, before making contact with the ground or an obstruction, or before reaching a prescribed load on the motor etc. Further, control of the fluid through the hydraulic circuit may be achieved by controlling the flow rate or opening or closing the flow using the various valves noted above that are shown and/or described. Further, as noted to avoid excess pressure in the hydraulic circuit, controller 120 may reverse the motor when controlling the valves described herein or may slow or stop the motor and pump before reaching the target (e.g. maximum height). Additionally, also as noted, controller 120 may control the hydraulic circuit by (1) adjusting the flow control valves or valves (e.g. valve 116), (2) adjusting the pump 92 (slow down or stop) or 3) adjusting both the flow control valves or valves (e.g. valve 116) and the pump, in any sequence.

Further, it should be understood, in each instance above, where it is described that the controller or sensor or other components are in communication, it should be understand that the communication may be achieved through hard wiring or via wireless communication. Further, although illustrated as discrete separate components, the various components may be assembled or integrated together into a single unit or multiple units.

As noted above, the frame 12 is optionally configured to allow the frame 12 to be tilted relative to the lift assembly 20 so that one end (e.g. head-end or foot-end) of the frame 12 can be raised beyond the fully raised height of the lift assembly to allow the patient handling apparatus to be inserted more easily into the compartment of an emergency vehicle. In addition, the frame 12 can be tilted without decoupling the frame 12 from the lift assembly 20.

In the illustrated embodiment, movable foot-end upper pivot connections 24*b* are configured so that they can move in a direction angled (e.g. oblique (acute or obtuse) or even perpendicular) relative to the longitudinal axis 12*b* of the frame 12 and optionally along or relative to the longitudinal axis 12*b* (FIG. 1) of the frame 12. In this manner, the movable foot-end upper pivot connections 24*b* follow a non-linear path P that takes them toward or away from the longitudinal axis 12*b* of the frame 12 over at least a portion of the range of motion of the movable foot-end upper pivot connections 24*b* to cause the frame 12 to tilt relative to the lift assembly 20 (as opposed to being tilted by the lift assembly).

Referring to FIGS. 1 and 2, this range of motion where the frame 12 tilts may be at one end of the range of motion of the foot-end upper pivot connections 24*b* and, for example, where lift assembly 20 is raised to its maximum height or may be intermediate the ends of path P. Further, after lift assembly 20 has raised frame 12 to its maximum raised height (see FIG. 2), frame 12 may be tilted further to raise the head-end of the frame 12 so that head-end wheel 12*a* can be raised sufficiently to rest on the deck of an emergence vehicle compartment.

Figure 3:
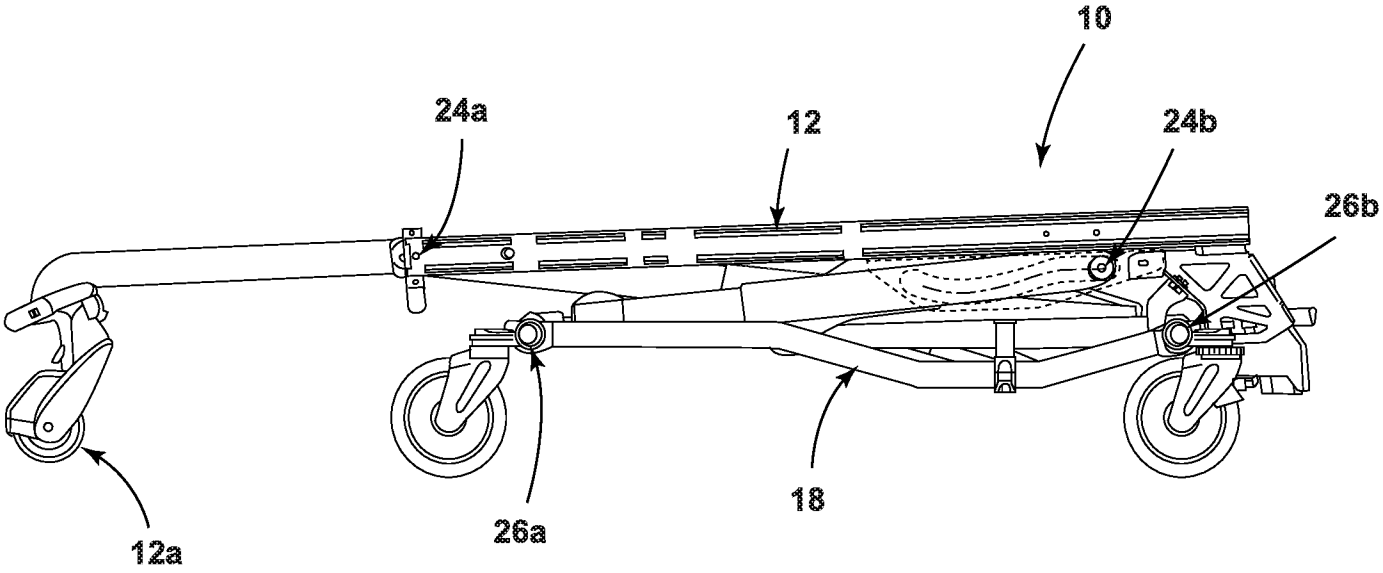
FIG. 3 is a side elevation view of the patient handling apparatus in its fully lowered configuration.

Referring again to FIG. 1, movable foot-end upper pivot connections 24*b* are mounted to frame 12 by guides 32. Guides 32 form a non-linear guide path P (FIGS. 1-5) ("non-linear path" means a path that does not form a straight line) for the movable foot-end upper pivot connections 24*b*. While guide path P is non-linear, path P may include one or more linear sections and one or more non-linear sections, such as arcuate sections. In the illustrated embodiment, guides 32 provide a non-linear guide path P with one linear section that corresponds to the lowered height (FIG. 3) of the lift assembly 20 where movable foot-end upper pivot connections 24*b* are at their lowest height and lift assembly 20 is in its folded, most compact configuration. The path P of each guide 32 also includes an arcuate section, which is the adjacent linear section and may have a single radius of curvature or two or more radii of curvatures. Further, the arcuate section may have two portions, with a first portion corresponding to the fully raised height of lift assembly 20 and a second portion corresponding to the fully raised height of lift assembly 20, but with the frame 12 tilted further (FIG. 2).

Thus, when lift assembly 20 starts in its lowermost position and is extended, movable foot-end upper pivot connections 24*b* move along guide path P from one end (which corresponds to the lowermost position of lift assembly 20) where the movement of movable foot-end upper pivot connections 24*b* is generally linear (and parallel to longitudinal axis 12*b* of frame 12) to a non-linear portion of path P, which corresponds to a raised position of lift assembly. As lift assembly 20 continues to extend and raise frame 12 further, movable foot-end upper pivot connections 24*b* continue to move along non-linear path P and initially move further away from longitudinal axis 12*b* (while still moving relative or along longitudinal axis 12*b*). During this movement, frame 12 remains substantially horizontal. As lift assembly 20 continues to extend to its fully raised position, movable foot-end upper pivot connections 24*b* continue to move along the non-linear portion of path P and, further, continue to move away from longitudinal axis 12*b*. This movement is then followed by movable foot-end upper pivot connections 24*b* moving toward longitudinal axis 12*b* where frame 12 tilts upwardly (FIG. 1). It should be understood that the positions of load bearing members 22 and movable foot-end upper pivot connections 24*b* are controlled and "locked" in their positions by the hydraulic cylinder. In order to further tilt frame 12 upwardly from its position shown in FIG. 1 to its position shown in FIG. 2, a downward force is applied to the foot-end of the litter, which causes movable foot-end upper pivot connections 24*b* to move toward the end of path P and move further towards longitudinal axis 12*b*, which causes frame 12 to further tilt upwardly. Because the position of foot-end upper pivot connections 24*b* is essentially locked in its position shown in FIG. 1, only an external force will cause upper pivot connections 24*b* to move to the end of path P as shown in FIG. 2. As noted this external force may simply be manually applied by an attendant (e.g. an EMS person) at the foot-end of the litter—or it may be applied by an actuator.

As best seen in FIG. 6, foot-end upper pivot connections 24*b* are supported on or formed by a transverse member 60, which is mounted to the upper ends of telescoping members 42 by a rigid connection. In the illustrated embodiment, foot-end upper pivot connections 24*b* are formed by the ends of transverse member 60. For example, transverse member 60 may comprise a tubular member or solid bar with a circular cross-section. To accommodate the rotation of each telescoping member 42 (as lift assembly is extended or retracted) and allow each telescoping member 42 at the foot-end to pivot and translate along guide path P, foot-end upper pivot connections 24*b* optionally each include a roller. The rollers are mounted about the respective ends of transverse member 60 and guided along guide paths P of guides 32. For example, the rollers may each comprise a low friction collar, such as a high density polyethylene collar, or a bearing assembly, which is free to rotate about the end of tubular member and further, as noted, roll along guide path P. Alternately, foot-end upper pivot connections 24*b* may be configured to slide along path P.

In the illustrated embodiment, guides 32 are each formed from a low friction member or plate, such as a high density polyethylene plate, mounted to frame 12. Each low friction member or plate 72 includes a recess formed therein, which forms guide path P. Alternately, guide 32 may be formed from a metal member or plate with the recess formed therein lined with a low friction material, such as high density polyethylene.

In this manner, pivot connections 26*b* allows telescoping members 42 to pivot about a moving horizontal axis (i.e.

moving horizontal axis of transverse member 60) (moving both in the longitudinal direction and/or vertical direction, as noted above, namely along longitudinal axis 12*a* or toward or away from longitudinal axis 12*a*) and, further, allow lift assembly 20 to adjust the height of frame 12 relative to base 18.

In addition, referring again to FIG. 2, frame 12 includes a pair of side frame members 14*a* and 14*b*, which are interconnected by cross- or transverse frame members 36*a* (only one shown). Cross-frame member 36*a* provides a mounting point for the head-end load bearing members 22 of lift assembly 20. In addition, side frame members 14*a* and 14*b* may provide a mounting surface for collapsible side rails (not shown).

For further details of frame 12, telescoping members 44, base 18, brackets 54 and 56, linkage members 50 and 52, and a gatch mechanism, and other structures not specifically mentioned or described herein, reference is made to U.S. Pat. Nos. 5,537,700 and 7,398,571, and published Application No. WO 2007/123571, commonly owned by Stryker Corporation, which are herein incorporated by reference in their entireties.

Thus, when the ambulance patient handling apparatus is in the fully collapsed position, and referring to FIG. 4, an extension of the linear actuator 30 will cause a clockwise (FIG. 4) rotation of the brackets 54, 56 about the axis of fasteners 55. Fasteners 55 secure the upper end of linkage members 50, 52 to X-frames 44. As a result of this geometry, the force in the direction of the extension of linear actuator 30 effects a rapid lifting of the frame 12 to the full height position of the lift assembly illustrated in FIGS. 1 and 2.

For further optional details on how lift assembly 20 is mounted to frame 12, reference is made to copending provisional application entitled EMERGENCY COT WITH A LITTER HEIGHT ADJUSTMENT MECHANISM (Attorney Docket 143667.173860 (P566), Ser. No. 62/488,441) and filed on even date herewith, which is incorporated herein by reference in its entirety.

The terms "head-end" and "foot-end" used herein are location reference terms and are used broadly to refer to the location of the cot that is closer to the portion of the cot that supports a head of a person and the portion of the cot that supports the feet of a person, respectively, and should not be construed to mean the very ends or distal ends of the cot.

While several forms of the invention have been shown and described, other forms will now be apparent to those skilled in the art. For example, one or more of the features of the cot 10 may be incorporated into other cots. Similarly, other features form other cots may be incorporated into cot 10. Examples of other cots that may incorporate one or more of the features described herein or which have features that may be incorporated herein are described in U.S. Pat. Nos. 7,100,224; 5,537,700; 6,701,545; 6,526,611; 6,389,623; and 4,767,148, and U.S. Publication Nos. 2005/0241063 and 2006/0075558, which are all incorporated by reference herein in their entireties. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A patient handling apparatus comprising:

a frame;

a base;

a lift assembly supporting said frame relative to said base, said lift assembly configured to extend or contract to raise or lower said base or said frame with respect to the other of said base and said frame; and a control system comprising:

at least one hydraulic cylinder to extend or contract said lift assembly, said hydraulic cylinder having a rod, a cap end chamber, and a rod end chamber, and said rod having an extension speed;

a hydraulic circuit to direct the flow of hydraulic fluid to and from said hydraulic cylinder, said hydraulic circuit including a cap side hydraulic conduit, a rod side hydraulic conduit, and a pump, said cap side hydraulic conduit in fluid communication with said pump, and said rod side hydraulic conduit in fluid communication with said pump, and said pump configured to pump fluid to and from said cap end chamber of said cylinder through said cap side hydraulic conduit and to pump fluid to and from said rod end chamber of said cylinder through said rod side hydraulic conduit, and said hydraulic circuit further including a third conduit in fluid communication with said rod side hydraulic conduit and said cap side hydraulic conduit allowing fluid communication between said rod end chamber and said cap end chamber without the fluid passing through said pump; and a controller operable to control said pump and said hydraulic circuit, and based on an input signal indicative of a status or condition of the patient handling apparatus, when said rod is extending said controller configured to open fluid communication between said rod end chamber and said cap end chamber through said third conduit to redirect a portion of the fluid output from said rod end chamber to said cap end chamber by by-passing the pump to thereby increase said extension speed of said rod.

2. The patient handling apparatus according to claim 1, wherein said control system includes a sensor, said sensor generating said input signal.

3. The patient handling apparatus according to claim 2, wherein said sensor is configured to detect the presence or absence of an external force being applied to said base, and said input signal being generated when said control system detects the absence of an external force being applied to said base.

4. The patient handling apparatus according to claim 1, wherein said controller is configured to close fluid communication between said rod end chamber and said cap end chamber through said third conduit when said rod is retracting or when an external force is applied to said base.

5. The patient handling apparatus according to claim 1, wherein said hydraulic circuit includes a valve to control said fluid communication between said rod end chamber and said cap end chamber, and said controller configured to adjust said valve.

6. The patient handling apparatus according to claim 5, wherein said valve comprises a solenoid valve, and said controller in communication with said solenoid valve to control opening or closing of said solenoid valve.

7. The patient handling apparatus according to claim 5, wherein said control system includes a sensor configured to detect the absence or presence of an external force applied to said base, and said controller being configured to open said valve in the absence of an external force applied to said base.

8. The patient handling apparatus according to claim 7, wherein said controller is configured to close said valve in the presence of an external force applied to said base and/or slow or stop the flow of fluid to the hydraulic cylinder.

9. The patient handling apparatus according to claim 7, wherein said control system further includes a patient handling apparatus-based communication system for communicating with a loading and unloading apparatus-based communication system on a loading and unloading apparatus.

10. The patient handling apparatus according to claim 9, wherein said apparatus-based communication systems are wireless.

11. The patient handling apparatus according to claim 9, wherein said controller is operable to open or close said solenoid valve based on a signal received from the loading and unloading apparatus-based communication system.

12. The patient handling apparatus according to claim 1, further comprising a motor to run said pump, wherein said control system is configured to detect a load on said motor, and said input signal being a function of said load on said motor, and said control system being configured to (1) close fluid communication between said rod end chamber and said cap end chamber through said third hydraulic conduit and/or (2) stop or slow the motor to thereby stop or slow fluid flow to the hydraulic cylinder from said pump when said load on said motor is near, is at, or exceeds a prescribed value.

13. The patient handling apparatus according to claim 1, wherein said control system is configured to detect the location of said frame relative to said base, and said controller being configured to (1) close fluid communication between said rod end chamber and said cap end chamber through said third hydraulic conduit and/or (2) slow or stop the flow of fluid to said hydraulic cylinder when said base is near or is at a prescribed location relative to said frame.

14. The patient handling apparatus according to claim 1, wherein said control system is configured to detect when said lift assembly is in a prescribed configuration, and said controller further configured to close the fluid communication between said rod end chamber and said cap end chamber when said lift assembly is in the prescribed configuration-.

15. A method of unloading the patient handling apparatus of claim 1 from a cargo area of an emergency vehicle, the method comprising:

moving the patient handling apparatus adjacent an opening to the cargo area of an ambulance;

extending the base of the patient handling apparatus beyond the cargo area wherein the base is no longer supported by the emergency vehicle;

directing hydraulic fluid from the pump to the cap end of the hydraulic cylinder to extend the rod; and automatically redirecting a portion of the hydraulic fluid discharged from the rod end chamber of the hydraulic cylinder to the cap end chamber of the hydraulic cylinder by by-passing the pump to increase the speed of the rod.

16. The method according to claim 15, further comprising stopping or slowing the flow of fluid to the hydraulic cylinder and/or terminating said redirecting when an external force is applied to the base.

17. The method according to claim 15, further comprising detecting when the base is supported by or contacts a ground surface, and further comprising stopping or slowing the flow of fluid to the hydraulic cylinder and/or terminating said redirecting when detecting that the base is supported by or contacts a ground surface.

18. The method according to claim 15, further comprising stopping or slowing the flow of fluid to the hydraulic cylinder and/or terminating said redirecting when the base is near or at a prescribed location relative to the frame.

19. The method according to claim 18, further comprising sensing when the base is near or at a prescribed location relative to the frame.

20. The method according to claim 15, further comprising further comprising stopping or slowing the flow of fluid to the hydraulic cylinder and/or terminating said redirecting based on the lift assembly being near or in a prescribed configuration.

21. A method of unloading a patient handling apparatus of claim 1 from a cargo area of an emergency vehicle, the patient handling apparatus comprising a frame, a base, a lift assembly supporting the frame relative to the base, the lift assembly configured to extend or contract to raise or lower the base or the frame with respect to the other of the base and the frame, and a control system comprising: at least one hydraulic cylinder to extend or contract the lift assembly, the hydraulic cylinder having a rod, a cap end chamber, and a rod end chamber, and the rod having an extension speed; a hydraulic circuit to direct the flow of hydraulic fluid to and from the hydraulic cylinder; and a controller operable to control the hydraulic circuit, and based on an input signal indicative of a status or condition of the patient handling apparatus, the controller configured to open fluid communication between the rod end chamber and the cap end chamber to redirect a portion of the fluid output from the rod end chamber to the cap end chamber when the rod is extending to thereby increase the extension speed of the rod, the method comprising:

moving the patient handling apparatus adjacent an opening to the cargo area of an ambulance;

extending the base of the patient handling apparatus beyond the cargo area wherein the base is no longer supported by the emergency vehicle;

directing hydraulic fluid to the cap end of the hydraulic cylinder to extend the rod; and automatically redirecting a portion of the hydraulic fluid discharged from the rod end chamber of the hydraulic cylinder to the cap end chamber of the hydraulic cylinder to increase the speed of the rod, and further comprising sensing the configuration of the lift assembly, and comparing the configuration of the lift assembly to the prescribed configuration.

22. The patient handling apparatus according to claim 1, when said rod is extending said controller configured to automatically open fluid communication between said rod end chamber and said cap end chamber through said third hydraulic conduit to redirect a portion of the fluid output from said rod end chamber to said cap end chamber by by-passing the pump to thereby increase said extension speed of said rod.

23. A patient handling apparatus comprising:

a frame;

a base;

a lift assembly supporting said frame relative to said base, said lift assembly configured for extending or contracting to raise or lower said base or said frame with respect to the other of said base and said frame; and a control system comprising:

a hydraulic cylinder having a rod, a cap end chamber, and a rod end chamber, said rod having an extension speed;

a hydraulic circuit controlling flow of hydraulic fluid to and from said hydraulic cylinder, said hydraulic circuit including a cap side hydraulic conduit, a rod side hydraulic conduit, and a pump, said cap side hydraulic conduit in fluid communication with said pump, and said rod side hydraulic conduit in fluid communication with said pump, said pump configured to pump fluid to and from said cap end chamber of said cylinder through said cap side hydraulic conduit and to pump fluid to and from said rod end chamber of said cylinder through said rod side hydraulic conduit, and said hydraulic circuit further including a third conduit in fluid communication with said rod side hydraulic conduit and said cap side hydraulic conduit allowing fluid communication between said rod end chamber and said cap end chamber without the fluid passing through said pump; and a controller to control said hydraulic circuit, said control system including a sensor, and based on an input signal from or status of said sensor said controller configured to redirect the fluid output from said rod end chamber to said cap end chamber through said third hydraulic conduit thereby by-passing said pump to thereby increase said extension speed of said rod.

24. The patient handling apparatus according to claim 23, wherein said sensor detects the presence or absence of an external force being applied to said base.

25. The patient handling apparatus according to claim 23, further comprising a motor, and said sensor detecting the load on said motor or said pump.

26. The patient handling apparatus according to claim 23, wherein said sensor detects the location of said base relative to said frame.

27. The patient handling apparatus according to claim 23, wherein said sensor detects a configuration of said lift assembly.

* * * * *